US006645093B2

(12) United States Patent
Sheppard

(10) Patent No.: US 6,645,093 B2
(45) Date of Patent: Nov. 11, 2003

(54) BASKETBALL SHOT TRAINER

(76) Inventor: Mark C. Sheppard, 17 West St., Franklin, NY (US) 13775

( * ) Notice: Subject to any disclaimer, the term of this patent is extended or adjusted under 35 U.S.C. 154(b) by 0 days.

(21) Appl. No.: 09/971,295

(22) Filed: Oct. 5, 2001

(65) Prior Publication Data

US 2003/0069094 A1 Apr. 10, 2003

(51) Int. Cl.[7] ..... A63B 69/00
(52) U.S. Cl. ..... 473/450; 473/422
(58) Field of Search ..... 473/450, 458, 473/464, 63, 422, 207, 212, 215, 275–277; 273/DIG. 19, 317, 317.6; 482/72, 105, 106, 114; 602/16; 2/44; 224/201, 266; 434/248

(56) References Cited

U.S. PATENT DOCUMENTS

| | | | | | |
|---|---|---|---|---|---|
| 475,432 | A | * | 5/1892 | Blades | 473/415 |
| 2,809,043 | A | * | 10/1957 | Brouwer | 473/212 |
| 3,820,783 | A | | 6/1974 | Caveness | |
| 4,383,685 | A | | 5/1983 | Bishop | |
| 4,579,341 | A | | 4/1986 | Furr | |
| 4,984,789 | A | | 1/1991 | Socci | |
| 5,154,416 | A | * | 10/1992 | Smull et al. | 473/458 |
| 5,271,617 | A | | 12/1993 | Gilford | |
| 5,320,342 | A | | 6/1994 | Houck | |
| D351,438 | S | | 10/1994 | Weaver | |
| 5,658,203 | A | * | 8/1997 | Shub | 473/205 |
| 5,865,695 | A | | 2/1999 | Mahala et al. | |
| 6,095,936 | A | | 8/2000 | Kirkpatrick et al. | |

* cited by examiner

*Primary Examiner*—Paul T. Sewell
*Assistant Examiner*—Mitra Aryanpour
(74) *Attorney, Agent, or Firm*—August E. Roehrig, Jr.; Hancock & Estabrook, LLP

(57) ABSTRACT

A basketball shot trainer for controlling the movement of the user's shooting arm in a predetermined direction and predetermined elbow placement. The shooter's arm is connected to an arm bar such that the shooting arm and elbow pivot in a predetermined manner relative to the user's torso. The shooting arm is held in the desired position on the user by means of a back plate which supports the arm bar for pivotal movement to control movement of the user's shooting arm. The arm bar has a guide portion which is secured to the user's shooting arm by an arm band which controls movement of the shooting arm in a predetermined vertical plane.

6 Claims, 3 Drawing Sheets

BASKETBALL SHOT TRAINER

BACKGROUND OF THE INVENTION

This invention relates in general to a basketball shooting training aid to increase the shooting skill of a basketball player and, more particularly, to a basketball shot trainer to aid a basketball player in developing a consistent basketball shot by positioning the player's arm and constraining the arm's movement during the shooting motion.

In developing and perfecting the shooting skill of a basketball player, it has been recognized that the performance and perfection of such skills are enhanced by the strengthening of the muscle groups involved, and exercising these muscles repeatedly in a consistent repetitive motion. A number of devices for training a basketball player's shooting skills have been developed for this purpose.

In L. E. Bishop, U.S. Pat. No. 4,383,685, "TRAINING AID FOR BASKETBALL PLAYERS", there is disclosed a shot training device including a vest 11 worn by the player and having a guide bar 22 made of a suitable metal or other suitable material pivotally mounted to the vest for guiding the user's arm in a generally vertical plane substantially parallel to the upper trunk portion of the user's body. The user wears an elastic sleeve 34 over the elbow of the shooting arm, and the elastic sleeve is attached to the guide bar 22 by a carriage 27 which includes an upper roller supported for rolling action along the guide bar 22.

Another basketball shooting training device is disclosed in G. H. Furr, U.S. Pat. No. 4,579,341, "SHOOTING GUIDE FOR BASKETBALL PLAYER". This device includes a harness 18 worn on the shooter's body, and having an L-shaped arm guide 20 including an elongated arm guide element or rod 34 having an outwardly flared front end portion 35. The arm guide member 20 may be adjusted laterally to confine the shooter's arm in a substantially vertical plane next to the player's body and to draw the elbow closer to the torso as each shot is executed.

G. W. Caveness, U.S. Pat. No. 3,820,783, "BASKETBALL TRAINING AID", discloses a belt supported 12, 14 transversely extending gage arm 40 which is mounted to a pivot arm 22 extending upwardly and forwardly of the user. The gage arm 40 is pivotally adjustable in a generally vertical plane extending outwardly and forwardly from the front of the user. The degree in which the arm 22 is pivoted outwardly and forwardly from the front of the user, is controlled by the positioning of a pin member 28 relative to one of a plurality of openings 24 formed in a sector plate 16 to which the arm 22 is pivotally attached. A guide bar 46 extends downwardly, and is laterally movable relative to the transverse gage arm 40 to indicate the proper position in which the player's elbow should be during shooting.

These prior art devices, as well as other devices in the prior art, are awkward requiring the use of components which either do not physically guide the arm in the desired shooting motion, thereby allowing the arm to move from the proper shot technique, or can distract and interfere with the player's shooting techniques, or both.

The present invention is intended to overcome one or more of the problems associated with the relevant technology.

SUMMARY OF THE INVENTION

In the preferred embodiment of this invention, an arm bar is utilized to control the movement of a user's shooting arm in a predetermined direction and predetermined elbow placement. The shooter's arm is connected to the arm bar such that the shooting arm and elbow pivot in a predetermined manner relative to the user's torso. The shooting arm is held in the desired position on the user by means of a back plate which extends across the back of a user's shoulders, and which pivotally mounts shooting arm guide bar. A front or chest plate, which covers a small portion of the user's chest, and the back plate use interconnecting straps to form an open "vest-like" light-weight structure having sufficient rigidity to hold the shooting arm guide bar in a proper position without interfering with the natural body movement of the user. The advantages obtained in accordance with the present invention, together with additional features contributing thereto, will be apparent from the following description of a preferred embodiment of the invention which is shown in the accompanying drawings wherein like reference numerals indicate corresponding parts throughout.

DESCRIPTION OF A PREFERRED EMBODIMENT

Figure 1:
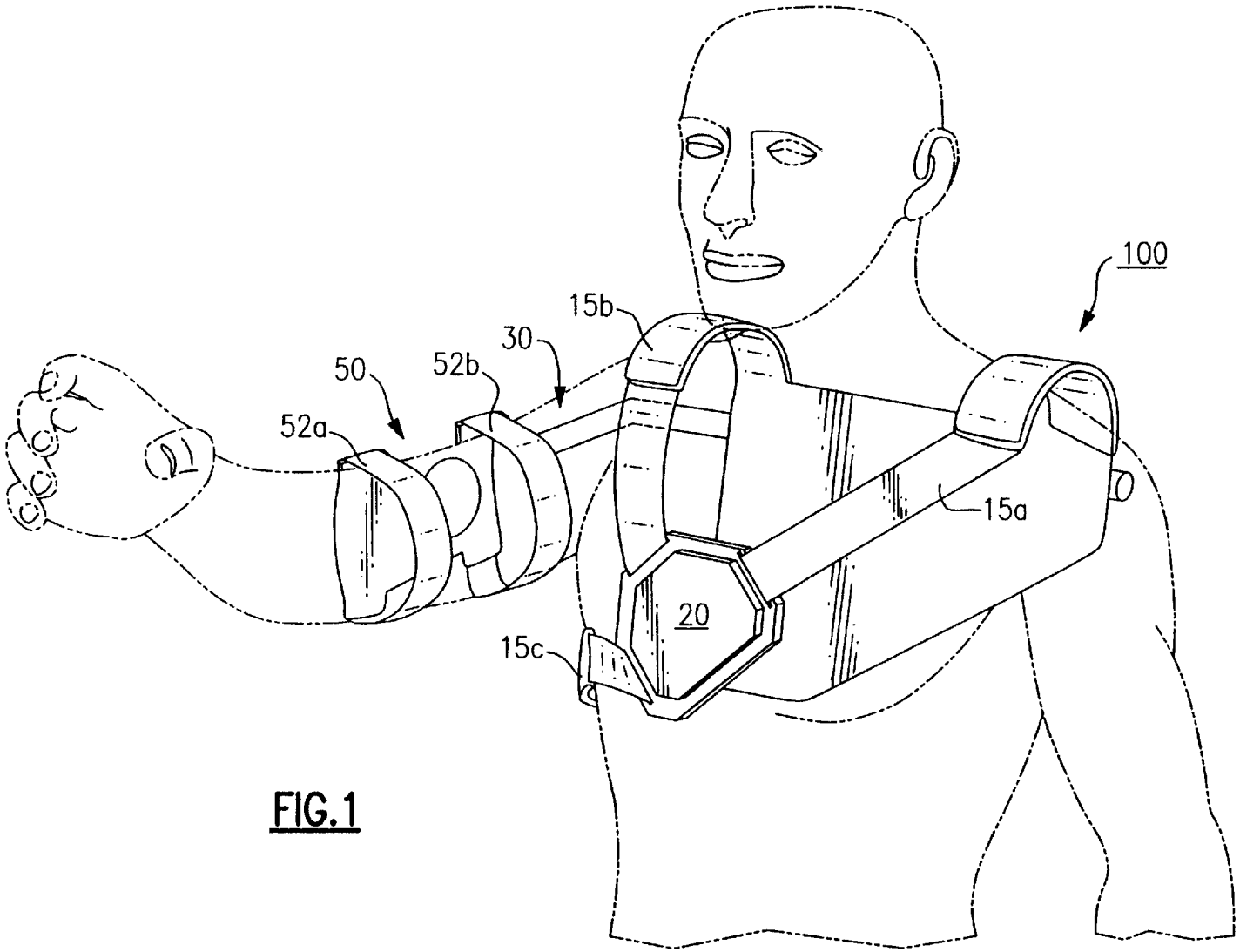
FIG. 1 is a frontal perspective view of the invention worn on a user.

Referring now to the drawings, the training device 100 includes a flat planar back plate 10 having a upper edge 11 which extends at the top a width approximately equal to that of a user's torso to permit the plate 10 to be worn over a user's back, while allowing the user's shoulders to move freely. A pair of straps 15*a* and 15*b* extend from the upper edge 11 of a back plate 10 and are passed over the user's shoulders for connecting to a chest plate 20 (shown in FIG. 2). The straps 15*a* and 15*b* are adjustable straps. Preferably the upper portion of the straps, which extends over the user's shoulders, is soft plastic and the remaining portion a hook and loop material sold under the trademark VELCRO.

The back plate 10 includes a hollow tube 25 extending across the width thereof and positioned adjacent the upper edge 11 of the a back plate 10. This tube 25 is sized to receive therein a support portion 35 of an arm bar 30 to provide pivotal movement of the support portion 35 about the coaxial axis of the support portion 35 and the tube 25. In this manner a guide portion 38 of the arm bar 30 may be pivoted in a predetermined vertical plane relative to the horizontal tube 25 secured to the back plate 10.

A distal end 39 of the guide portion 38 carries a connector 40 which is slidable along the length of the guide portion 38 of the arm bar 30. The connector 40 includes a tube portion 42 positioned coaxial with the guide portion 38 of the arm bar 30. A connecting coupler portion 45 extends outwardly from the tube portion 42 of the connector 40 and includes a stepped circular-shaped portion 46 for engaging a complimentary portion of an arm band 50 which is securable to the arm of a user. In this manner a user's shooting arm is constrained for movement in a predetermined vertical plane by the rotation of the arm bar support portion 35 relative to the back plate 10 in which the support portion 35 of the arm bar 30 is connected and the rotatable connector portion 40 which is longitudinally movable along the guide bar portion 38 permits the unrestrained movement of the user's elbow in this predetermined vertical plane.

A lower bottom edge 13 of the back plate 10 extends a width substantially less than that of the upper edge 11 to permit more freedom of movement of the user. A strap 15*c* extends from a vertical edge 16 of the back plate, and connects to the front or chest plate 20 providing a three point connection of the chest 20 and back 10 plates. The chest plate 20 is formed as a truncated octagon, five portions of which are equal in length and provide for the engagement of the straps 15*a*, 15*b*, and 15*c*, with the remaining portion of the octagon removed to eliminate unnecessary restriction on the movement of the user.

Figure 2:
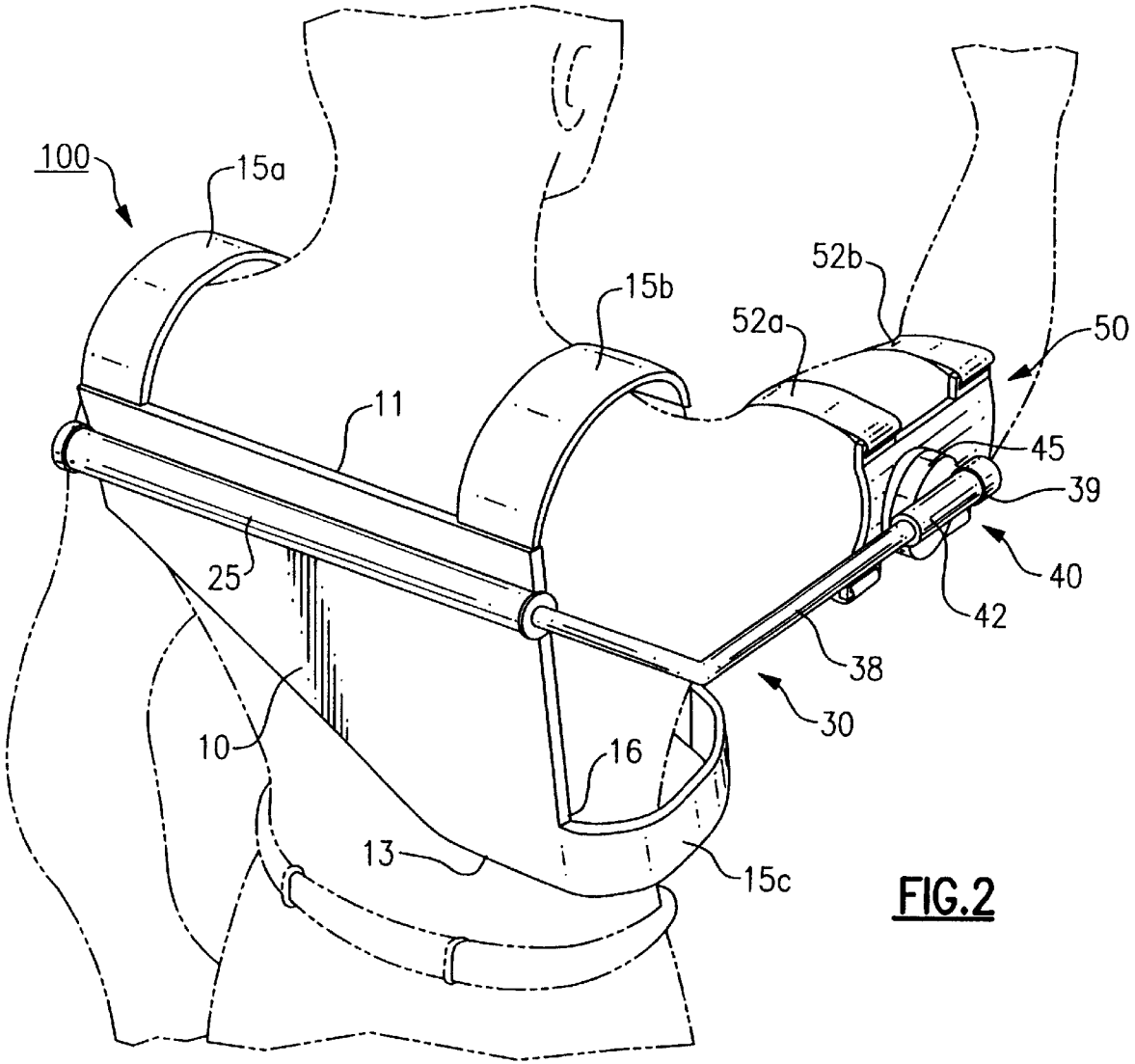
FIG. 2 is a rear perspective view of the invention worn by a user.
Figure 3:
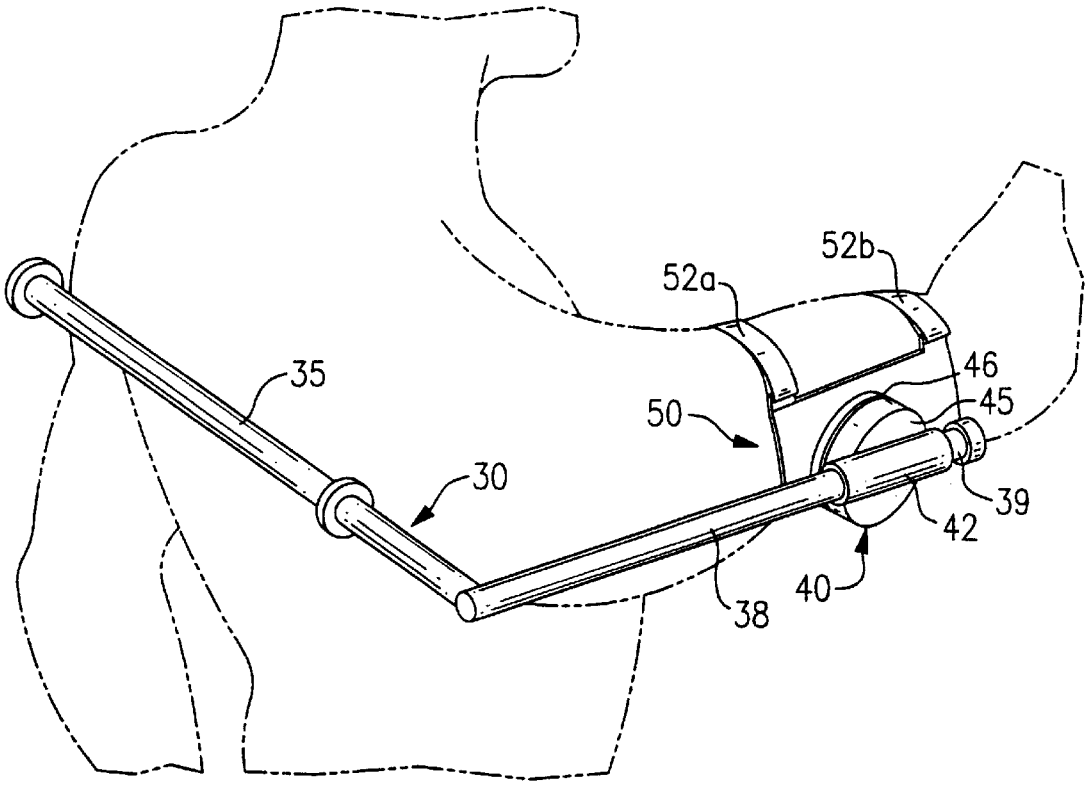
FIG. 3 is perspective view of the arm bar and arm band coupler.
Figure 4:
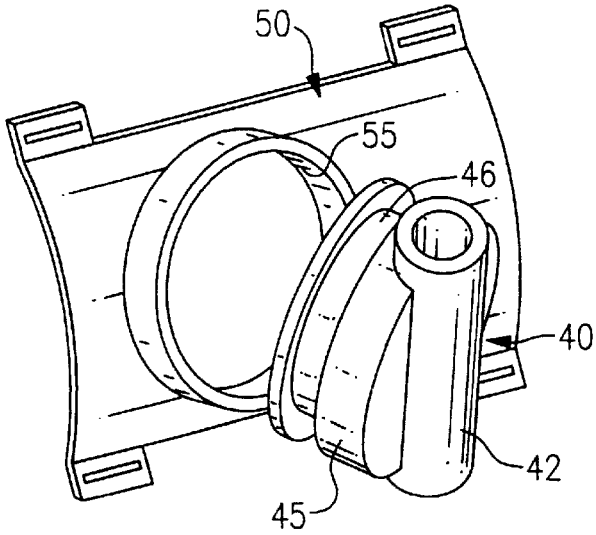
FIG. 4 is an exploded perspective view of an arm band and connector which is connected to the arm bar through the arm band coupler.

Referring now to FIGS. 1 and 2, the arm band 50 is secured to the shooting arm of a user by means of two hook and loop adjustable straps 52*a* and 52*b*. The portion of the arm band 50 which extends outwardly from a user's arm is formed with an outwardly extending recessed coupler 55 which is complimentary to the connector 45 mounted on the arm bar guide portion 38 for receiving therein the stepped outer lip 46 of the coupler into the complimentary undercut portion 55 of the arm band 50.

Industrial Applicability

In use a user places the straps 15*a* and 15*b* of the back plate 10 over the shoulders. These straps may be made of a loop and hook material or of a soft plastic which will conform to the user's shoulders while allowing an adjustable connection to the chest plate 20. The strap 15*c* at the lower vertical edge 16 of the back plate 10 is also connected to the chest plate 20 providing a three-point connection of the back plate 10 to the chest plate 20 securing the harness to the user, but providing the maximum amount of unrestricted user movement. The arm bar 30, is pivoted to a position for engaging the user's shooting arm, and the arm band 50 is connected to the shooting arm by means of the straps 52*a* and 52*b*. With the shot trainer 100 so positioned on the user, the user's shooting arm is controlled in a predetermined vertical plane for controlling the user's shot. In this manner, the user's arm cannot move inwardly or outwardly from the predetermined vertical plane, but must consistently move in the desired plane. In this manner the user's shot accuracy will be increased and be consistent.

While the invention has been described in the specification and illustrated in the drawings with reference to a preferred embodiment, it will be understood by those skilled in the art that various changes may be made and equivalence may be substituted for elements of the invention without departing from the scope of the claims. In addition, modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A basketball shot training device adapted to be worn by a user and having a shooting arm guide attachable to the user's shooting arm for developing correct shooting arm movement, said basketball shot training device comprising:

a pivotable arm bar having a first support portion adapted to be supported on the back of a user for pivotal movement in response to the movement in a vertical plane of the user's shooting arm;

said pivotable arm bar having a second shooting arm guide portion extending at an angle from said first support portion and adapted to be attached to the user's shooting arm for movement therewith;

shooting arm attachment means carried by said second shooting arm guide portion of said pivotable arm bar for releasably securing said pivotable arm bar to the user's shooting arm for movement therewith; and torso attachment means for securing said first support portion adapted to be supported on the back of a user in a position wherein said first support portion extends across the users upper back and shoulders, and said second shooting arm guide portion extends at an angle therefrom adjacent to the user's shoulder and shooting arm for movement in a plane normal to a longitudinal axis of said first support portion adapted to be supported on the back of a user.

2. The basketball shot training device of claim 1 wherein said shooting arm attachment means includes:

a connector member carried by said second shooting arm guide portion of said pivotable arm bar and having a shooting arm connecting portion adapted to be releasably secured to the shooting arm of the user to constrain the movement of the user's shooting arm in a vertical plane relative to the user's shooting arm shoulder.

3. The basketball shot training device of claim 2 wherein said connector member carried by said second shooting arm guide portion of said pivotable arm bar further includes a slidable tubular portion carried thereon and slidable along and rotatable about the longitudinal axis of said second shooting arm guide portion.

4. The basketball shot training device of claim 3 wherein said shooting arm connecting portion includes a plate member releasably attachable to the user's shooting arm and pivotally connected to said tubular portion to permit the user's shooting arm to pivot relative to said second shooting arm guide portion of said pivotable arm bar.

5. The basketball shot training device of claim 1 wherein said torso attachment means includes:

a back plate positioned adjacent the user's back for supporting said first support portion of said pivotable arm bar;

a front plate positioned adjacent the user's chest and operatively connected to said back plate for positioning said torso attachment means on the torso of a user; and a plurality of releasable connectors connected to said back plate and said front plate for connection thereof about the torso of a user.

6. The basketball shot training device of claim 5 wherein said back plate extends along an upper portion of the user's back adjacent to and between the shoulders of a user, and a lower portion thereof extends adjacent to the user's lower back with one of said releasable connectors extending about the user's torso beneath the user's shooting arm.

* * * * *